United States Patent [19]

Tanahashi

[11] 4,452,341

[45] Jun. 5, 1984

[54] LOAD CHANGE RESPONSIVE ELEVATOR SPEED CONTROL APPARATUS

[75] Inventor: Toru Tanahashi, Aichi, Japan

[73] Assignee: Mitsubishi Denki Kabushiki Kaisha, Tokyo, Japan

[21] Appl. No.: 347,116

[22] Filed: Feb. 9, 1982

[30] Foreign Application Priority Data

Feb. 12, 1981 [JP] Japan ..... 56-19271

[51] Int. Cl.[3] ..... B66B 1/30

[52] U.S. Cl. ..... 187/29 R

[58] Field of Search ..... 187/29

[56] References Cited

U.S. PATENT DOCUMENTS 2,439,608 4/1948 Krauer ..... 187/29

3,470,438 9/1969 Krauer et al. ..... 187/29

3,543,113 11/1970 Miller ..... 187/29 X 4,101,013 7/1978 Duriez et al. ..... 187/29

*Primary Examiner*—B. Dobeck

*Assistant Examiner*—W. E. Duncanson, Jr.

*Attorney, Agent, or Firm*—Sughrue, Mion, Zinn, Macpeak and Seas

[57] ABSTRACT

A floor relay contact 15 is connected between an elevator cage load detecting device 14 and a memory circuit 16. Just before the cage 7 reaches a desired floor the relay contact is closed to apply the output of the load detecting device 14 to a traction motor current control circuit 12 via the memory. This minimizes any acceleration-deceleration bumps and eliminates any vertical gap between the accessed floor sill and the stopped position of the cage when passengers exit before the cage comes to a complete halt.

1 Claim, 10 Drawing Figures

LOAD CHANGE RESPONSIVE ELEVATOR SPEED CONTROL APPARATUS

BACKGROUND OF THE INVENTION

This invention relates to an improved elevator speed control apparatus for regulating the running speed of an elevator cage to accommodate load changes when passengers exit before the cage comes to a complete halt at an accessed floor.

A conventional elevator speed control system is shown in FIG. 1, wherein an electric power converter 2 which comprises a plurality of thyristors connected in a 3-phase bridge configuration, is coupled to a 3-phase AC power source 1 and generates DC power that is supplied to an armature 3 of a DC elevator drive motor through a line 2*a*. The field winding for the motor is not shown in the drawing.

A tachometer generator 4 driven by the armature 3 produces a speed signal on line 4*a* proportional to the rotation speed of the armature. A traction sheave 5 also driven by the armature 3 drives an elevator cage 7 and a counterweight 8 through a main cable 6 as is well known. A speed arithmetic circuit 10 receives the speed signal on line 4*a* from the tachometer generator 4 and a speed instruction signal on line 9*a* from a speed instruction signal generator 9 as inputs, and generates a current instruction signal on output line 10*a*. The speed arithmetic circuit 10 along with the speed instruction signal generator 9 and the tachometer 4 constitute a speed control system.

A current arithmetic circuit 12 receives as inputs the current instruction signal on line 10*a* from the speed arithmetic circuit 10 and a current signal on line 11*a* from a current detector 11 proportional to the current supplied to the converter 2. A phase shifter 13 receives the output signal on line 12*a* from the current arithmetic circuit 12 as an input, and outputs a firing control signal on line 13*a* for the converter 2. The current arithmetic circuit 12 along with the current detector 11 constitute a current control system.

By controlling the firing angle or phase of the thyristor converter 2 by means of both the speed control and current control systems, the voltage applied to the armature 3 is correspondingly controlled and thus the running speed of the elevator cage 7 is controlled through the traction sheave 5. In other words, the elevator cage 7 is speed controlled in accordance with the difference between the speed instruction signal on line 9*a* and the actual speed signal on line 4*a* with a high degree of accuracy.

In the aforementioned speed control system, in order to compensate for the non-linearity of the converter 2, the response time of the minor loop constituted by the current control system is set at an extremely short value, generally in the range of 0.01 to 0.03 second. On the other hand, the response time of the main loop constituted by the overall speed control system must be set at a higher value in order to avoid resonances in the suspension and traction cables. Consequently, the speed control system is generally designed so as to have a response time in the range of 0.2 to 0.33 second.

With such a conventional elevator system, in order to improve the transport efficiency and speed up the overall operation both the internal cage door and the external door on the accessed floor are sometimes controlled to be simultaneously opened just before the cage reaches the floor. A brake system (not shown) is also provided to engage the traction sheave 5, but such engagement does not occur until the cage comes to a complete stop. Passengers may thus step out of the cage before the brake system acts upon the traction sheave, and as a result an abrupt variation in torque is exerted on the sheave due to the change in the cage load or weight, as shown in FIG. 2(*a*).

Upon the occurrence of a torque variation, the current flowing through the armature 3 correspondingly varies in response to the output of the speed arithmetic circuit 10 due to the functioning of the current control system, as described above. In this case, however, based on the relatively slow response time characteristics of the speed control system the current flowing through the armature 3 varies or adjusts relatively slowly as shown in FIG. 2 (*b*). The running speed of the cage 7 therefore varies as shown in FIG. 2 (*c*), as a result of which the cage may overshoot or undershoot the exact position of the accessed floor, which constitutes a potentially dangerous situation. Even in the best case where the cage ultimately stops at the exact position of the floor sill, the passengers will experience a discomforting "acceleration-deceleration bump".

It will be understood that the curves of FIG. 2 have been simplified by removing or subtracting therefrom the normal transient values, to leave just the "abnormal"variants caused by a premature passenger exit (or entry).

SUMMARY OF THE INVENTION

It is thus an object of this invention to provide an elevator speed control apparatus which is capable of eliminating or at least minimizing any undesired undershoot or overshoot between an accessed floor sill where the cage is to be stopped and the position where the cage is actually stopped, as well as any acceleration-deceleration bump, even though one or more passengers may have exited the cage before the brake system acts upon the traction sheave.

It is another object of the invention to provide an elevator speed control apparatus which exhibits excellent control and performance characteristics without causing the passengers to feel uncomfortable or endangered.

The aforementioned objects are attained by providing a load detecting device for detecting the load in the elevator cage, and means for applying the output of the load detecting device to the current control system when the load in the cage abruptly changes.

DETAILED DESCRIPTION OF THE PREFERRED EMBODIMENT

Figure 1:
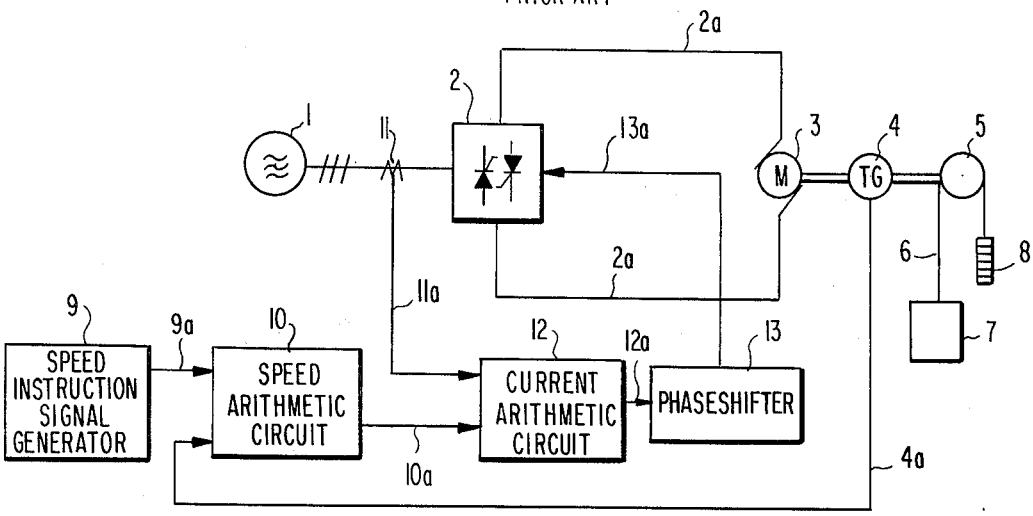
FIG. 1 PRIOR ART
FIG. 1 shows a schematic diagram of a conventional elevator speed control apparatus, FIGS. 2(*a*), 2(*b*) and 2(*c*) are simplified time plots of operating parameters for the apparatus shown in FIG. 1.
Figure 2:
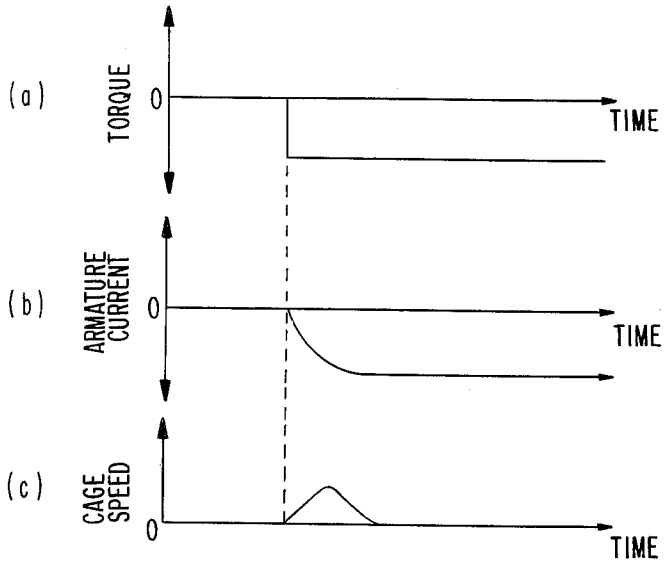
FIG. 2 PRIOR ART
Figure 3:
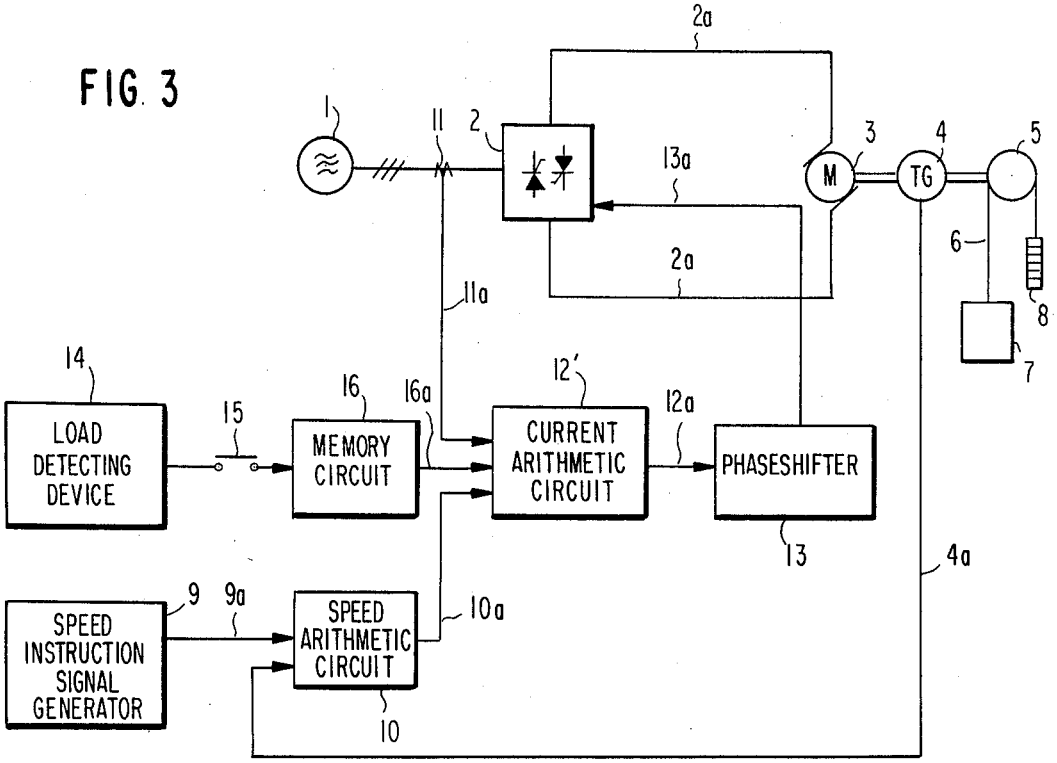
FIG. 3 shows a schematic diagram of an elevator speed control apparatus according to a preferred embodiment of this invention.
Figure 4:
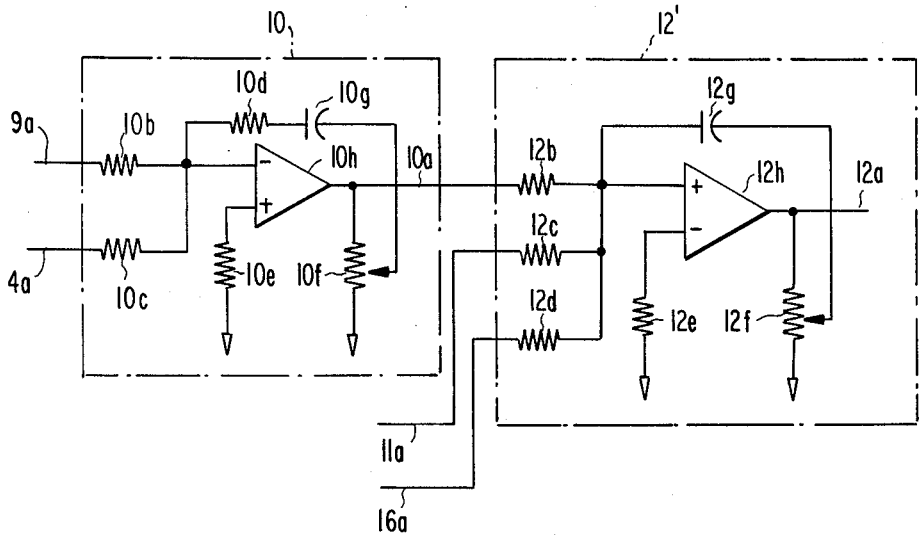
FIG. 4 shows a detailed circuit configuration of the speed and current arithmetic circuits shown in FIG. 3, and FIGS. 5(*a*), 5(*b*), 5(*c*) and 5(*d*) are simplified time plots of operating parameters for the apparatus shown in FIG. 3.
Figure 5:
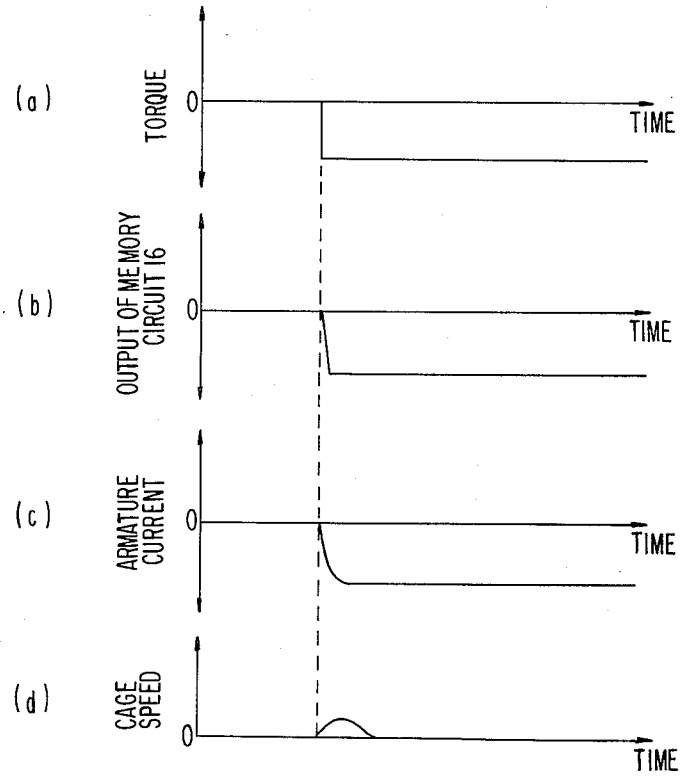

With reference to FIGS. 3 through 5, a preferred embodiment of the present invention will now be described. In FIG. 3, reference numeral 14 designates a load detecting device provided for the cage 7 which produces an output corresponding to the load in the cage, and which may take any one of a number of conventional forms. The device 14 may, for example, comprise a vibration absorbing rubber element mounted between the cage floor and an underlying support beam, and a differential transformer affixed to such element which detects its compression in response to the number of passengers and converts it to an electrical signal. A floor relay contact 15 is connected to the output of the load detecting device 14, and is held open during the running of the cage 7. The relay contact is closed just before the cage reaches a desired floor by any suitable means (not shown), and reopened again just before the cage is restarted. A memory circuit 16 is provided between the relay contact 15 and the current arithmetic circuit 12'. The remaining circuit components correspond to those shown in FIG. 1 and are designed by the same reference numerals.

FIG. 4 shows an embodiment of the speed and current arithmetic circuits 10, 12' shown in FIG. 3. The speed arithmetic circuit comprises resistors 10*b* through 10*e*, a variable resistor 10*f*, a capacitor 10*g*, and an operational amplifier 10*h*; the current arithmetic circuit comprises resistors 12*b* through 12*e*, a variable resistor 12*f*, a capacitor 12*g*, and an operational amplifier 12*h*.

The speed signal on line 4*a* from the tachometer generator 4 and the speed instruction signal on line 9*a* from the speed instruction signal generator 9 are different in polarity. When the cage 7 is moving up the speed instruction signal on line 9*a* is positive and the speed signal on line 4*a* is negative, and vice versa when the cage is moving down. The amplifier 10*h* along with the feedback resistor 10*d* and capacitor 10*g* integrates the difference signal between the two inputs to generate the current instruction signal on output line 10*a*.

Furthermore, the current signal on line 11*a* from the current detector 11 is different in polarity from the other two signals on lines 10*a* and 16*a*. The amplifier 12*h* along with the feedback capacitor 12*g* integrates the difference signal between the three inputs to generate the voltage instruction signal on output line 12*a*.

In operation, AC power produced by the power supply 1 is converted to DC by the converter 2 and supplied to the armature 3. At the same time, the speed arithmetic circuit 10 calculates the deviation between the speed instruction value on line 9*a* and the tachometer generator speed signal on line 4*a*, and applies the current instruction signal on line 10*a* to the current arithmetic circuit 12'. The latter then calculates the deviation between the current instruction signal 10*a*, the detected current signal on line 11*a* and the output signal on line 16*a* from the memory circuit 16, and applies an output signal on line 12*a* to the phase shifter 13. The phase shifter then operates to control the firing angle of the thyristors in the converter 2 in response to the output of the current arithmetic circuit 12'.

The floor relay contact 15, as mentioned above, is maintained closed while the cage 7 is stopped, and is opened immediately before the cage is started up, upon door closure for example. During the running operation of the cage the memory circuit 16 thus stores the last output of the load detecting device 14, which was produced just before the cage was restarted. The floor relay contact 15 prevents the memory circuit 16 from being affected by the changing output from the load detecting device 14 in response to the acceleration and deceleration of the cage.

As the cage 7 approaches a desired floor, the relay contact 15 is closed to cause the value stored in the memory circuit 16 to vary in accordance with the output of the load detecting device 14. At the same time, and as described above, the cage and floor doors are opened just before reaching the accessed floor sill; the door opening signal may also be used to close the relay contact 15.

If any passengers now exit the cage 7 before the brake system acts upon the traction sheave 5, an abrupt variation in torque as shown in FIG. 5(*a*) is exerted not only on the traction sheave but also on the armature 3. The output of the load detecting device 14 thus changes in response to the decreased cage load, as does the value stored in the memory circuit 16 through the closed relay contact 15. The variation of the output of the memory circuit 16 is shown in FIG. 5(*b*).

Due to the quick response of the current arithmetic circuit 12', the current flowing through the armature 3 varies abruptly as shown in FIG. 5(*c*), closely following the output of the memory circuit 16. As a result, the running speed of the cage 7 is more smoothly controlled as shown in FIG. 5(*d*) and the "disruption bump" is minimized, whereby any undesired distance between the accessed floor sill and the cage stop position is substantially eliminated.

Consequently, excellent cage control is maintained even when an abrupt variation in torque due to passengers exiting before the brake system engages the traction sheave is exerted on the armature 3.

What is claimed is:

1. An elevator speed control apparatus, comprising:
   (a) a DC elevator drive motor,
   (b) means for controlling the running speed of the motor and attendantly the running speed of an elevator cage driven thereby, said means including:
      (1) a speed control system constituting a main loop and having a relatively slow response time, and
      (2) current control system constituting a minor loop and having a relatively fast response time,
   (c) a load detecting device (14) for detecting the load in said cage, and
   (d) means for reducing acceleration-deceleration bumps when passengers exit or enter the cage before it comes to a complete halt,
   (e) said bump reducing means comprising a memory circuit (16) for storing the output of said load detecting device, and switch means (15) connected between said load detecting device and said memory circuit, and
   (f) wherein said switch means comprises a floor relay contact maintained opened during the running of the cage, and maintained closed from just before the cage reaches a desired floor up to just before the cage is started again.

* * * * *